US005168861A

United States Patent [19]

Lutzen et al.

[11] Patent Number: 5,168,861

[45] Date of Patent: Dec. 8, 1992

[54] DIRECT CONTACT WATER HEATER

[75] Inventors: William C. Lutzen, Brookfield; Gerald A. Roszak, Brown Deer, both of Wis.

[73] Assignee: Ludell Manufacturing Company, Milwaukee, Wis.

[21] Appl. No.: 796,038

[22] Filed: Nov. 20, 1991

[51] Int. Cl.[5] ..... F24H 1/10

[52] U.S. Cl. ..... 126/355; 126/359

[58] Field of Search ..... 126/355, 359, 350 R, 126/360 R, 360 A, 362; 122/20 A, 40, 39, 28

[56] References Cited

U.S. PATENT DOCUMENTS

| | | | |
|---|---|---|---|
| 884,223 | 4/1908 | Shipley | 126/355 |
| 893,084 | 7/1908 | Loomis | 126/355 |
| 2,651,299 | 9/1953 | Brown, Jr. | 126/85 |
| 2,759,328 | 8/1956 | Cockrell | 60/39.56 |
| 3,190,283 | 6/1965 | Miyahara | 126/359 |
| 3,386,436 | 6/1968 | Miyahara | 126/359 |
| 3,648,682 | 3/1972 | Bougard | 126/359 |
| 3,826,240 | 7/1974 | Miyahara | 126/355 |
| 3,994,281 | 11/1976 | Godart | 126/361 |
| 4,275,708 | 6/1981 | Wood | 126/355 |
| 4,530,347 | 7/1985 | Baker et al. | 126/360 |
| 4,574,775 | 3/1986 | Lutzen et al. | 126/355 |
| 4,753,220 | 6/1988 | Lutzen et al. | 126/355 |

FOREIGN PATENT DOCUMENTS

| | | | |
|---|---|---|---|
| 582792 | 11/1946 | United Kingdom | 126/355 |

*Primary Examiner*—James C. Yeung

*Attorney, Agent, or Firm*—Michael, Best & Friedrich

[57] ABSTRACT

A direct contact water heater including a column having a plurality of heat exchange bodies disposed in the upper end thereof, water distributions means disposed above the heat exchange bodies for distributing water downwardly thereon, and heating means disposed in the lower end of the column, the heating means including a combustion chamber coupled to the column, one end of the combustion chamber being constructed and arranged to receive a burner and the other end being coupled to and communicating with the column beneath the heat exchange bodies, the sides of the combustion chamber flaring outwardly from the first end to the other end for receiving expanding combustion gasses passing into the column.

5 Claims, 1 Drawing Sheet

DIRECT CONTACT WATER HEATER

BACKGROUND OF THE INVENTION

The invention relates to water heaters, and more particularly to direct contact water heaters.

Direct contact water heaters, such as those disclosed in U.S. Pat. Nos. 4,275,708 and 4,574,775 generally comprise a vertically oriented cylindrical column having a plurality of heat exchange bodies disposed adjacent its upper end. A spray nozzle is disposed in the upper end of the column for spraying the water to be heated downwardly onto the heat exchange bodies. A gas burner extends through an opening in the column and below the heat exchange bodies for injecting a flame radially inwardly toward the axis of the column. The hot gasses from the flame pass upwardly in counter-flow to the water to be heated, which flows downwardly and around the heat exchange bodies.

In the water heater disclosed in U.S. Pat. No. 4,275,708, the burner flame was directed inwardly toward a plate at the opposite side of the column for directing gasses upwardly and away from the wall of the combustion chamber. This configuration resulted in incomplete combustion, which lowers efficiency and causes high levels of carbon monoxide (CO) in the discharge gasses. In addition, a local hot spot was produced on the gas diversion plate, causing higher than acceptable levels of nitrogen oxide (NOx). These deficiencies were alleviated to some extend by the water heater disclosed in U.S. Pat. No. 4,574,775 wherein the heated gasses were injected tangentially into the combustion chamber, thereby increasing efficiency and decreasing levels of carbon monoxide and nitrogen oxide in the discharge gasses. However, this tangential method of firing also caused hot spots in the vicinity of the burner which resulted in levels of NOx which exceeded permissible limits in certain locations.

SUMMARY OF THE INVENTION

It is an object of the invention to provide a new and improved direct contact water heater.

A further object of the invention is to provide a direct contact water heater which provides increased efficiency and lower levels of CO and NOx in the discharge gasses than prior art direct contact water heaters.

These and other objects and advantages of the present invention will become more apparent from the detailed description taken with the accompanying drawings.

In general terms, the invention comprises a direct contact water heater which includes a column having heat exchange means disposed adjacent the upper end thereof, water distributions means disposed above the heat exchange means for distributing water downwardly thereon, and heating means coupled to the column below the heat exchange means. The heating means includes a combustion chamber coupled to said column, one end of said combustion chamber being constructed and arranged to receive a burner and the other end being coupled to and communicating with the column beneath the heat exchange means, the cross-sectional area of the combustion chamber being progressively larger from the first end to the other end for receiving expanding combustion gasses passing into said column.

DETAILED DESCRIPTION OF THE PREFERRED EMBODIMENT

Figure 1:
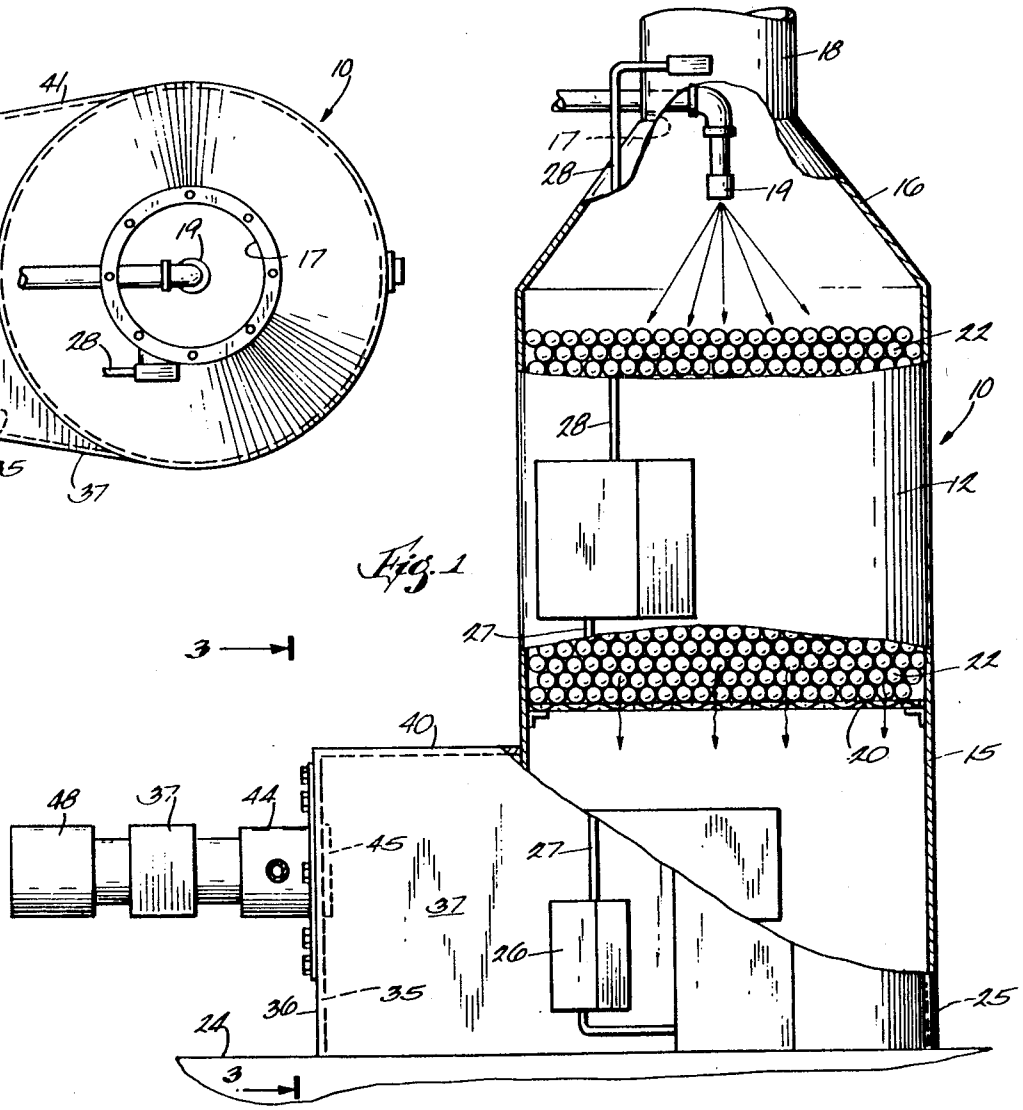
FIG. 1 is a front elevational view, partly in section, of a direct contact water heater which incorporates a combustion chamber according to the preferred embodiment of the invention.
Figure 2:
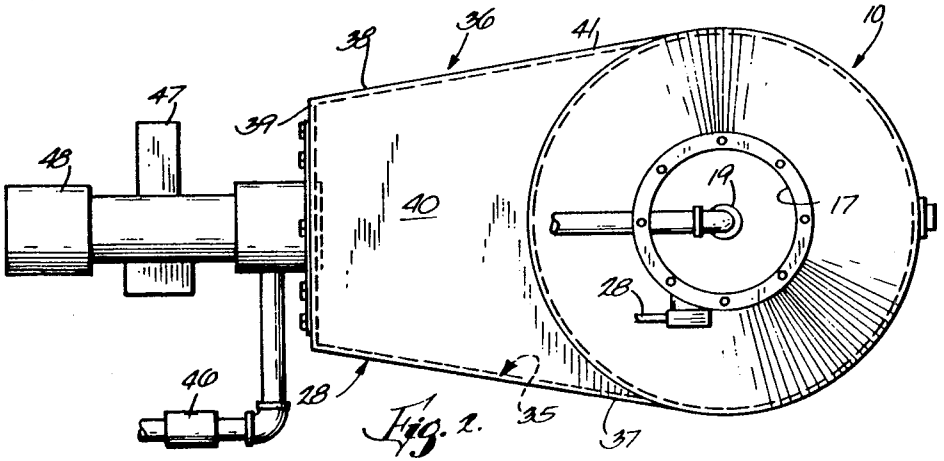
FIG. 2 is a top plan view thereof.
Figure 3:
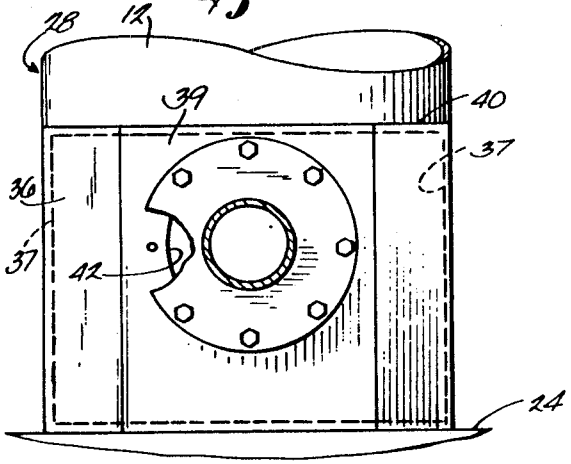
FIG. 3 is a front view thereof.

The direct contact water heater 10 in accordance with the preferred embodiment of the invention is shown in FIG. 1 to include a vertically oriented, open-ended tubular column 12 formed of any suitable metallic material. A tubular jacket 14 is disposed within column 12 and is spaced therefrom to provide an annular flow path 15 therebetween. While the column 12 is shown to be cylindrical, it may have any convenient shape. The upper end of jacket 14 extends above the upper end of the column 12 and is closed by a conical cover 16 having an opening 17 which is connected to a flue 18.

A spray nozzle 19 is disposed adjacent the upper end of column 12 and is connected to a source of water, as will be discussed more fully below. Extending horizontally across the column 12 and spaced above its lower end is a support screen 20 which supports a plurality of heat exchange bodies 22. The screen 20 is affixed to the inner surface of column 12 in any suitable manner. As those skilled in the art will appreciate, the heat exchange bodies 22 generally comprise a hollow tubular, spherical or egg-shaped member having perforations or slots for absorbing heat from combustion products passing therethrough and for transferring the same to water flowing in the opposite direction. Since the heat exchange bodies 22 are conventional and well-known in the art, they will not be discussed in detail for the sake of brevity.

In the preferred embodiment, the column 12 and the jacket 14 are shown to be supported atop a water storage tank 24. The open lower end of the column 12 communicates with the tank, while the lower end of the flow path 15 is closed by an annular barrier member 25 extending between the column 12 and jacket 14. It is also contemplated that the column 12 and jacket 14 will be free-standing and connected to a separate water storage tank.

A suitable pump 26 has its inlet connected to the tank 24 and its outlet to pipes 27 and 28 for delivering heated water for use or for delivering cold water to the spray nozzle 19 for heating.

The combustion chamber 23 includes an inner shell 35 and an outer shell 36 defined by a pair of vertical side walls 37 and 38 which are each tangent with the cylindrical wall of the column and on the opposite sides thereof. The walls 37 and 38 diverge inwardly from the point of tangency to a generally rectangular end wall 39. In addition, there is a flat, horizontally oriented cover 40 which overlays the combustion chamber 28. The inner shell 35 includes corresponding components as the outer shell 36 and which are spaced from the outer shell to provide a gap 41 or flow path therebetween for receiving cooling water. The gap 41 communicates with the annular flow path 15.

An opening 42 is formed in the end wall 39 for receiving a burner 44 therein. The burner 44 is conventional and need not be described in detail for the sake of brevity. It is sufficient for purposes of understanding the invention to state that the burner 44 includes a nozzle 45 connected to a source of gaseous fuel by a pipe 46 and to a fan 47 or similar device for providing combustion air. In addition, there is a controller 48 for controlling the operation of the burner 44.

The combustion chamber 23 is configured so that as the combustion gasses expand and flow inwardly toward the lower end of the column 12, they move into areas of increasing volume. In addition, at the sides of the combustion chamber, the gasses move in a direction parallel to the side walls 37 and 38 and tangentially relative to the walls of column 12. As a result, hot spots in the combustion chamber are minimized so that the formulation of NOx is maintained below acceptable limits. In addition, more complete combustion is achieved so that increased efficiency and a lower level of CO emissions are realized.

In operation of the water heater, cold water is initially discharged downwardly from nozzle 18 onto the heat exchange bodies 22 within the column 12. This water flows downwardly through the column and the screen 20 which supports the bodies 22. In the meantime, a suitable fuel/air mixture is delivered to the burner 44 which provides a flame that expands outwardly as it moves toward the lower end of column 12. These hot combustion gasses flow upwardly through the screen 20 and the heat exchange bodies 22 and counter to the water flowing downwardly. The combustion gasses release heat to the bodies 22 which, in turn, transfer the same to the downwardly flowing water. This heated water collects in the tank 24 for delivery by pump 26 to an outlet pipe (not shown). Water is also delivered to the lower end of the gap 41 and this flows upwardly through the gap 15 between the column 12 and the housing 14 and provides a medium for cooling the walls of the combustion chamber 23 in the lower end of the column 12.

The waste gasses exiting the stack 18 have levels of NOx and CO which are below acceptable limits. In addition, the temperature of the waste gasses exiting through the stack are only a few degrees above that of the inlet water, which is the result of relatively high efficiency.

While only a single embodiment of the invention has been illustrated and described, it is not intended to be limited thereby, but only by the scope of the appended claims.

What is claimed is:

1. A direct contact water heater including a column having heat exchange means disposed in the upper end thereof, water distribution means disposed above said heat exchange means for distributing water downwardly thereon, and heating means coupled to said column below said heat exchange means, said heating means including a combustion chamber coupled to said column, and having inlet and outlet ends, the inlet end of said combustion chamber being constructed and arranged to receive a burner and the outlet end being coupled to and communicating with said column beneath said heat exchange bodies, the flow direction of gasses in said combustion chamber being from said inlet to said outlet end, the cross-sectional area of said combustion chamber being progressively larger from said inlet to said outlet end for receiving expanding combustion gasses passing into said column, the width of the combustion chamber at its outlet end being substantially equal to that of the column.

2. The combustion chamber set forth in claim 1 wherein the sides of said combustion chamber flare outwardly from the inlet end to the outlet end and intersect the column at its diametrically opposite sides.

3. The combustion chamber set forth in claim 2 wherein the combustion chamber is oriented radially relative to the column.

4. A direct contact water heater including a generally cylindrical column having heat exchange means disposed in the upper end thereof, water distribution means disposed above said heat exchange means for distributing water downwardly thereon, and heating means coupled to said column below said heat exchange means, said heating means including a combustion chamber coupled to said column, one end of said combustion chamber being constructed and arranged to receive a burner and the other end being coupled to and communicating with said column beneath said heat exchange bodies, the sides of said combustion chamber flaring outwardly from the first end to the other end and being tangential to spaced apart locations of said column, so that the cross-sectional area of said combustion chamber being progressively larger from said first to said other end for receiving expanding combustion gasses passing into said column.

5. The water heater set forth in claim 4 wherein said heat exchange means comprises a plurality of heat exchange bodies.

* * * * *